US005239305A

United States Patent [19]

Murphy et al.

[11] Patent Number: 5,239,305

[45] Date of Patent: Aug. 24, 1993

[54] MAILBOX DEPOSIT INDICATOR SYSTEM

[75] Inventors: Colleen M. Murphy, 717 Stepney Rd., Easton, Conn. 06612; John P. Shea, Jr., Stratford, Conn.

[73] Assignee: Colleen M. Murphy, Easton, Conn.

[21] Appl. No.: 922,623

[22] Filed: Jul. 30, 1992

[51] Int. Cl.[5] ..... G06B 1/08; H04Q 7/00

[52] U.S. Cl. ..... 340/539; 340/569; 232/35; 232/36

[58] Field of Search ..... 340/539, 568, 569; 455/38.1, 38.2; 232/33, 35, 36

[56] References Cited

U.S. PATENT DOCUMENTS

| | | | |
|---|---|---|---|
| 3,222,665 | 12/1965 | Tracy | 340/569 |
| 3,556,394 | 1/1971 | Caldes | 232/36 |
| 3,572,581 | 3/1971 | McLeod | 232/35 |
| 3,611,333 | 10/1971 | Conigliaro | 340/539 |
| 3,707,260 | 12/1972 | Gelineau, Sr. et al. | 340/539 |
| 4,372,482 | 2/1983 | Clerigues | 232/36 |
| 4,520,350 | 5/1985 | Huang | 340/569 |
| 4,794,377 | 12/1988 | Benages | 340/539 |

*Primary Examiner*—Donnie L. Crosland
*Attorney, Agent, or Firm*—Ware, Fressola, Van Der Sluys & Adolphson

[57] ABSTRACT

A system for indicating the deposit of mailing mailbox comprises a two channel transmitter positioned within a mailbox and a two channel receiver positioned within a household. The first channel of the system provides a means for indicating at the receiver the opening of the mailbox door (deposit of mail) and the second channel of the system provides a means for resetting the indication of a deposit of mail. The transmitter and receiver both have means for resetting the indication of a deposit of mail. The transmitter has a spring clip for attachment to the mailbox.

8 Claims, 3 Drawing Sheets

MAILBOX DEPOSIT INDICATOR SYSTEM

FIELD OF THE INVENTION

The present invention relates to a system for indicating the deposit of mail in a mailbox, and more particularly to an electronic mailbox deposit indicator system for a rural mailbox wherein the system is resetable at the mailbox.

BACKGROUND OF THE INVENTION

Heretofore, prior art electric and electronic mailbox deposit indicator devices have been made wherein such devices are installed in rural mailboxes for the purpose of indicating that mail has been deposited in the box. Prior art devices typically involve the use of a switch or a plurality of switches to sense the weight of deposited mail or movement of the mailbox door, thus actuating a signal means to indicate the presence of a deposit of mail. When such indicator devices are used for rural mailboxes, the signaling means often employ a wire signaling means or wire-less signaling means which transmits to a receiving means located at the household. The receiving means indicates the deposit of mail in the mailbox. The systems of the prior art employing switch sensing means are typically unable to distinguish whether mail is deposited by a mail carrier or deposited by a member of the household for pickup by the mail carrier. Thus, when mail is deposited by a member of the household, the household remote receiving means of such indicator systems must be reset by returning to the household and resetting the receiving means. The mail deposit indicator of the present invention provides a means for remotely resetting the receiving means from the signaling means inside mail box thus eliminating the inconvenience of returning to the household.

SUMMARY OF THE INVENTION

The present invention relates to an indicator system for indicating the deposit of mail in a mailbox having a hinged door thereon. The indicator system comprises a two channel transmitter, wherein said transmitter has means for transmitting a first signal on a first channel and transmitting a second signal on a second channel. The transmitter has a first input electrically connected to the transmitting means for activating transmission of the first signal on the first channel. The transmitter has a second input electrically connected to the transmitting means for activating transmission of the second signal on the second channel. The transmitter also has a means for outputting the first and second signals.

The indicator system also includes a first switch having a first terminal and a second terminal. The first terminal is electrically connected to the first input of the transmitter and the second terminal is electrically connected to a source of electrical power. The first switch is responsive to the opening and closing of the hinged mailbox door. The indicator system further includes a second switch having a first terminal and a second terminal. The first terminal is electrically connected to the second input of the transmitter and the second terminal is electrically connected to a source of electrical power.

The signals transmitted by the transmitter are received by a two channel receiver. The receiver has an input responsive to the output of the transmitter. The receiver has a receiving means electrically connected to the input for receiving the first signal on the first channel and for receiving the second signal on the second channel. The receiver has a first output and second output electrically connected to the receiving means.

Mail detection is provide by a logic flip flop having a first input, a second input and an output. The first input is electrically connected to the first output of the receiver. A reset function is provided by a logic OR gate having a first input, a second input and an output, wherein the first input is electrically connected to the second output of said receiver, and the output is electrically connected to the second input of the logic flip flop, and a third switch having a first terminal and a second terminal, wherein the first terminal is electrically connected to a source of electrical power, and the second terminal is electrically connected to the second input of the logic OR gate. Mail indication is provide by an indicator means having an input electrically connected to the output of the logic flip flop.

An object of the present invention is to provide an indicator system for the deposit of mail.

Another object of the present invention is to provide an indicator system for the deposit of mail in a rural mailbox.

Another object of the present invention is to provide a means at the mailbox for resetting the indication of a deposit of mail at the mailbox.

Other objects and advantages of the present invention will become apparent to those skilled in the art from the following detailed description read in conjunction with the attached drawings and claims appended hereto.

DETAILED DESCRIPTION OF THE INVENTION

Figure 1:
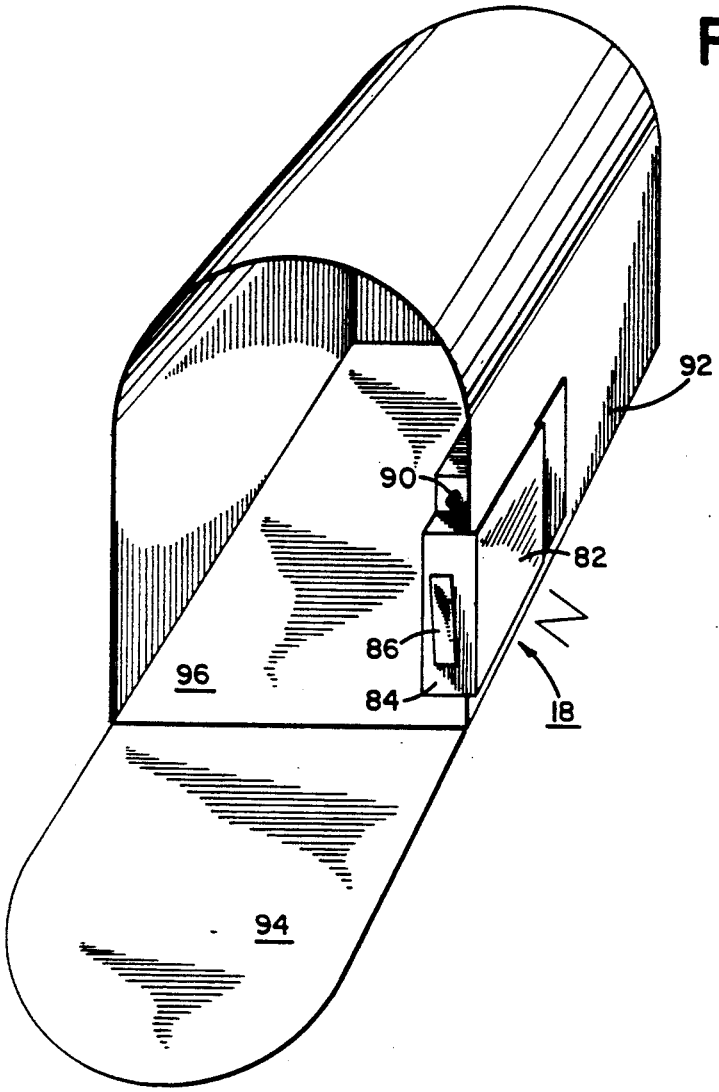
FIG. 1 is an isometric view of a mailbox having therein the transmitter of the present invention.
Figure 2:
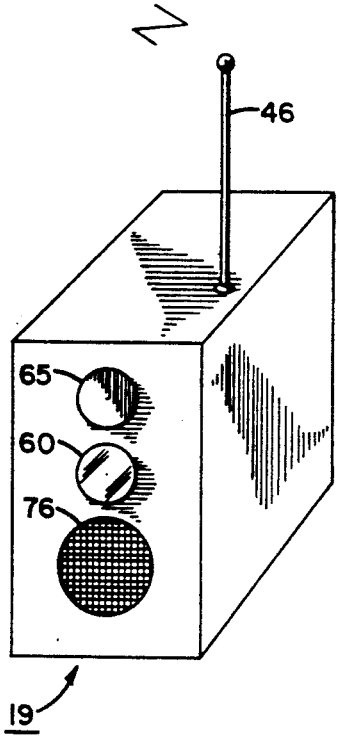
FIG. 2 is an isometric view of the receiver of the present invention showing the indicators and the reset switch.
Figure 7:
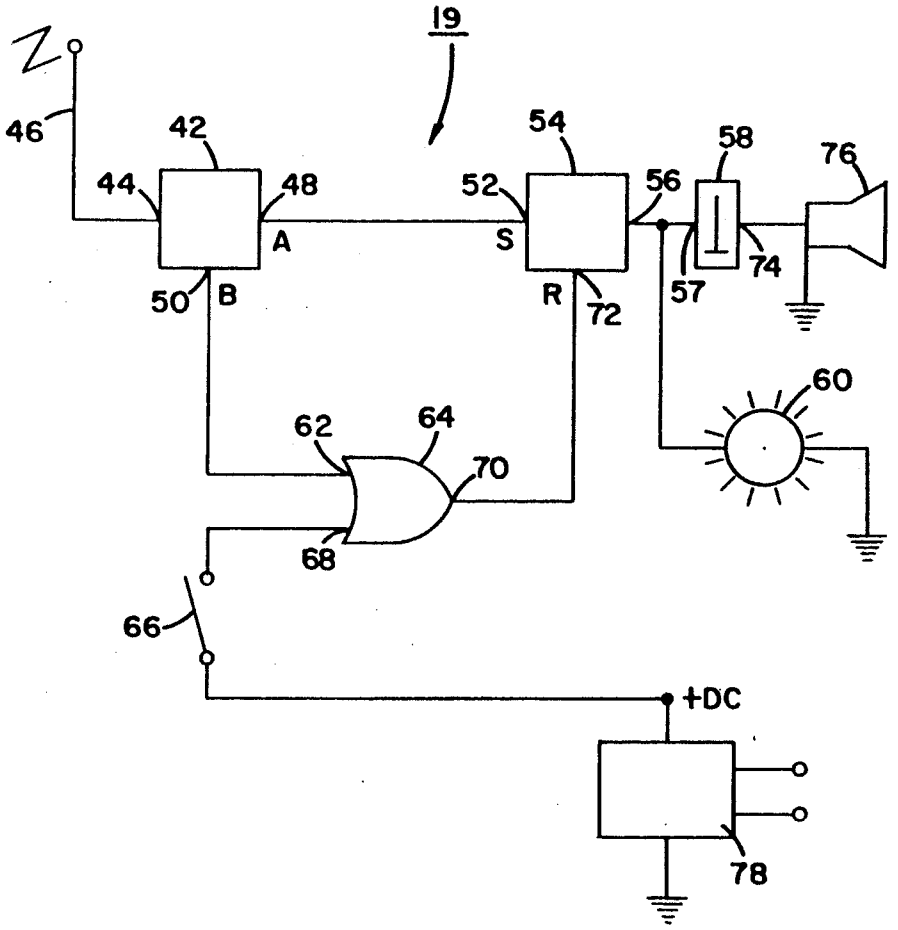
FIG. 7 is a schematic diagram of the circuit for the receiver-indicator.
Figure 6:
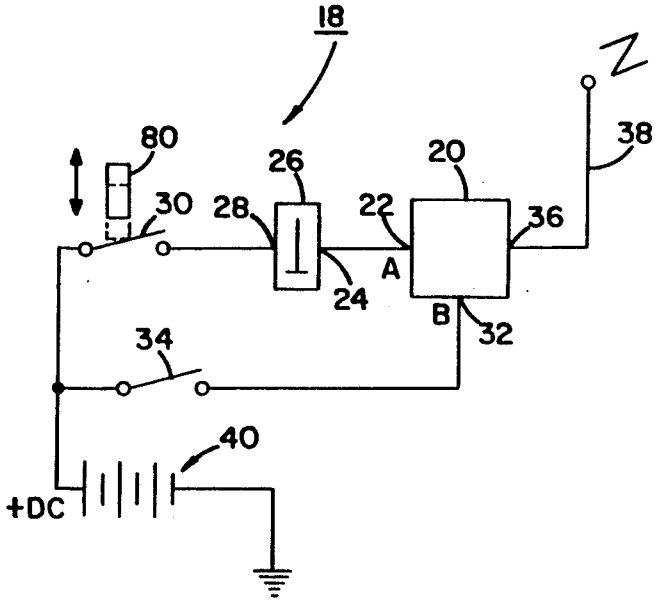
FIG. 6 is a schematic diagram of the circuit for the transmitter.

Referring to FIGS. 1, 2, 6 and 7 the mailbox deposit indicator system of the present invention comprises a transmitter unit 18 and a separate receiver-indicator unit 19. The transmitter unit comprises a two channel (Channel A and Channel B) radio frequency (rf) transmitter 20 of a frequency modulation (frequency shift keying) or pulse width modulation type. The transmitter 20 has a first input 22 (channel A input) connected to an output 24 of a one-shot monostable multi-vibrator 26 having an input 28 connected to a terminal of a normally closed switch 30 (activate switch) which is held open by a shut mailbox door. The transmitter unit also comprises a second input 32 (channel B input) connected to a terminal of a normally open switch 34 (reset switch) and an output 36 connected to an antenna 38. The activate switch 30 and the reset switch 34 are connected to a source of power 40. The one-shot monostable multi-vibrator 26 provides a means for conserving the source of power 40 by limiting the length of transmission by the transmitter 20.

The receiver-indicator unit 19 comprises a receiver 42 capable of detecting and decoding two rf channels. The unit 19 has an input 44 connected to an antenna 46 and a first output 48 (channel A output) and a second output 50 (channel B output). The channel A output 48 is connected to a first input 52 of set/reset (S/R) flip flop (bistable multi-vibrator) 54 whose output 56 is connected to an input 57 of one-shot monostable multivibrator 58 and an indicator light 60. The channel B output 50 is connected to a first input 62 of an OR gate 64. A normally open switch 66 is connected to a second input 68 of OR gate 64. Output 70 of OR gate 64 is connected to a second input 72 of the S/R flip flop 54. Output 74 of one-shot 58 is connected to an audio indicator 76. The receiver-indicator unit 19 and switch 66 are connected to a source of power 78.

Figure 5:
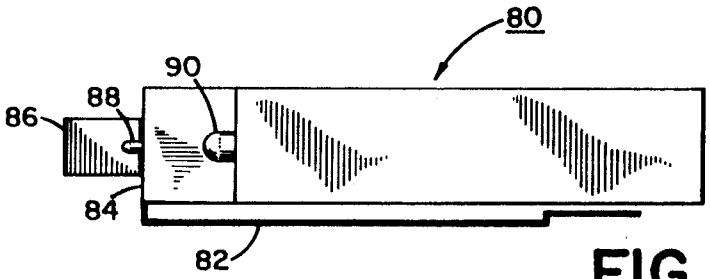
FIG. 5 is a top view of the transmitter of the mailbox deposit indicator of the present invention.
Figure 3:
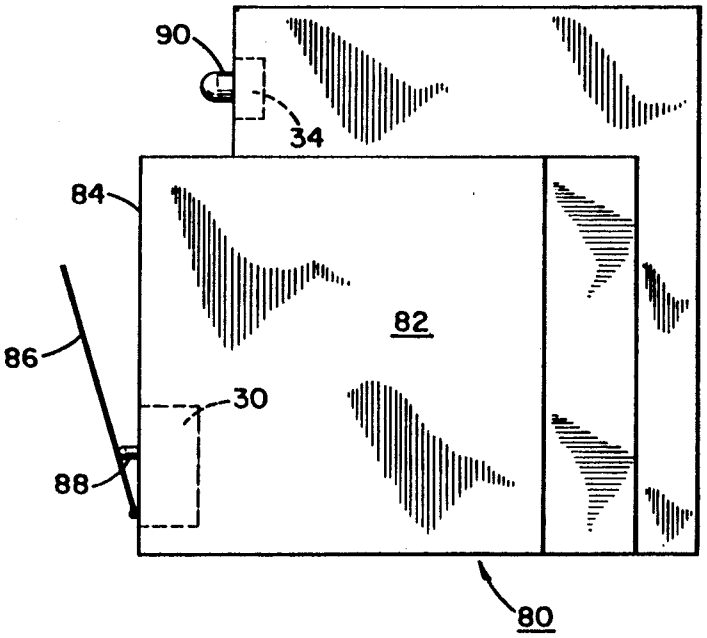
FIG. 3 is a side view of the transmitter of the mailbox deposit indicator system of the present invention.
Figure 4:
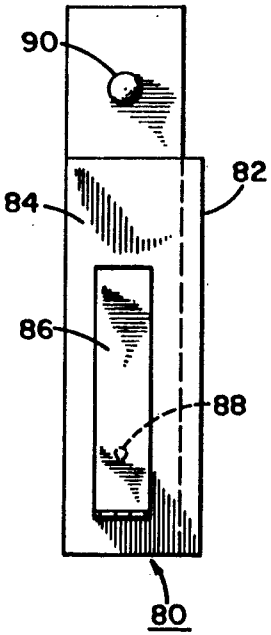
FIG. 4 is a front view of the transmitter of the mailbox deposit indicator system of the present invention illustrating the relative positioning of the reset switch and the actuating switch.

Referring to FIGS. 1, 2, 3, 4 and 5, a mailbox 92 having a door 94 pivotally attached at its bottom floor 96 is shown with transmitter unit housing 80 installed therein. The transmitter unit housing 80, containing the transmitter unit 18 therein, is shown having a spring clip 82 affixed to a front face 84. A lever 86 is pivotally attached below button 88 of activate switch 30 and button 90 of reset switch 34. The transmitter unit housing 80 is held in the mailbox interior by the spring clip 82. The transmitter unit housing 80 is positioned so that a wall of the mailbox is disposed between the transmitter unit housing 80 and the spring clip 82, so that the front face 84 is exposed when the mailbox door is opened, and so that when the mailbox door 94 is closed, lever 86 is pivotally moved by the door towards the housing thereby forcing button 88 to be pushed inward into the housing 80. Alternatively, the housing may be held in place by a piece of hook and loop (velcro) fastening material glued to the housing 80 and the mailbox 92.

When the mailbox door 94 is opened, activation switch 30 closes due to the release of force exerted by the door on the lever and inturn on button 88. The closure of the indication switch 30 cause the transmitter to transmit an rf signal on channel A to the receiver for a period of time determined by the one-shot multi-vibrator 26. The receiver detects and decodes the channel A transmission and causes a pulse to be sent from output 48 to the S/R flip flop 54 which flips to a first state (set) of two states and outputs a signal from output 56 which causes indicator light 60 to illuminate and causes the one-shot 58 to activate the audio indicator 76 for a period of time. When the mailbox door is shut, the door forces lever 86 to depress button 88 of switch 30 thereby opening the switch and terminating the transmission of the channel A transmission. However, the S/R flip flop 54 remains in the first state (set) and continues to output a signal at output 56 which corresponds to receipt of the channel A transmission, and thus continues to supply a corresponding signal to the visual indicator 60.

The visual indicator 60 and audio indicator 76 can be extinguished (reset) by one of two means. First, the indicators can be reset by pushing button 65 which momentarily closes switch 66 on the receiver and sends a signal to input 68 of OR gate 64. The OR gate 64 responds to the input signal by outputting a signal from output 70 to the second input 72 of the S/R flip flop 54 causing the S/R flip flop to flip to the second state (reset) and terminate the output of the signal at output 56 which corresponds to receipt of the channel A transmission. The indicators can also be reset by momentarily closing reset switch 34 on the transmitter by depressing button 90. The momentary closure of reset switch 34 causes a channel B transmission by the transmitter. The receiver detects and decodes the channel B transmission and causes a pulse to be generated at output 50 which is received at input 62 of OR gate 64. Similar to the closure of switch 66, the OR gate responds to the input signal by outputting a signal from output 70 to the second input 72 of the S/R flip flop 54. The signal input at the second input 72 causes the S/R flip flop to flip to the second state (reset) and terminate the output of the signal at output 56, thereby extinguishing the signal input to the visual indicator 60 and the audio indicator 76.

In another embodiment, button 90 and switch 34 may be replaced with an integral key-switch (not shown) to provide a measure of security for the resetting of the system.

While the invention disclosed herein has been shown for the purpose of indicating a deposit of mail in a mailbox, the present invention may be adapted by those skilled in the art so as to provide an indicator for indicating the opening of a gate such as yard gates, or pool area gates.

Thus, what has been described is a mailbox deposit indicator system for visually and audibly indicating the deposit of mail in a mailbox, the system having a reset button both at the transmitter and receiver for resetting the indication of a deposit when mail has been deposited by a member of the household for pickup by the mail carrier. While the preferred embodiment of the present invention has been described and illustrated, it is understood that the preferred embodiment is capable of variation, addition, omission, and modification without departing from the spirit and scope of the invention.

What is claimed is:

1. An indicator system for indicating the deposit of mail in a mailbox having a hinged door thereon, comprising:

a two channel transmitter, wherein said transmitter has means for transmitting a first signal on a first channel and transmitting a second signal on a second channel, said transmitter has a first input electrically connected to a monostable multi-vibrator which is electrically connected to said transmitting means for activating transmission of said first signal on said first channel, said transmitter has a second input electrically connected to said transmitting means for activating transmission of said second signal on said second channel, and said transmitter has a means for outputting said first and second signals;

a first switch having a first terminal and a second terminal, said first terminal is electrically connected to said first input of said transmitter and said second terminal is electrically connected to a source of electrical power, wherein said first switch is responsive to the opening and closing of said hinged mailbox door;

a second switch having a first terminal and a second terminal, said first terminal is electrically connected to said second input of said transmitter and said second terminal is electrically connected to a source of electrical power;

a two channel receiver, said receiver has an input responsive to said output of said transmitter, wherein said receiver has a receiving means electrically connected to said input for receiving said first signal on said first channel and for receiving said second signal on said second channel, said receiver has a first output and second output electrically connected to said receiving means;

a logic flip flop having a first input, a second input and an output, said first input is electrically connected to said first output of said receiver;

a logic OR gate having a first input, a second input and an output, said first input is electrically connected to said second output of said receiver, and said output is electrically connected to said second input of said logic flip flop;

a third switch having a first terminal and a second terminal, said first terminal is electrically connected to a source of electrical power, and said second terminal is electrically connected to said second input of said logic OR gate; and an indicator means having an input electrically connected to said output of said logic flip flop.

2. The indicator system of claim 1, wherein said output of said transmitter is electrically connected to an antenna and said transmitter transmits a radio frequency signal.

3. The indicator system of claim 1, wherein said input of said receiver is electrically connected to an antenna and said receiver is receptive to a radio frequency signal.

4. The indicator system of claim 1, wherein said indicator means comprises an audible indicator means and visual indicator means.

5. The indicator system of claim 4, wherein said audible indicator means further comprises means for automatically extinguishing said audible indication after a period of time.

6. The indicator system of claim 1, further comprising a housing for enclosing said transmitter, said housing has a first face, said housing includes a spring clip attached to said housing which extends along a portion of said housing so as to provide a surface substantially parallel to a surface of said housing, said housing includes a first button protruding from said first face mechanically connected to said first switch and a second button mechanically connected to said second switch, and a lever pivotally attached at a position adjacent to said first button so as to allow said lever to pivot toward said first face and make contact with said first button.

7. The indicator system of claim 1, said second button and switch includes a means for preventing its closure by unauthorized persons.

8. An indicator system for indicating the deposit of mail in a mailbox having a hinged door thereon, comprising:

a two channel transmitter, wherein said transmitter has means for transmitting a first signal on a first channel and transmitting a second signal on a second channel, said transmitter has a first input electrically connected to said transmitting means for activating transmission of said first signal on said first channel, said transmitter has a second input electrically connected to said transmitting means for activating transmission of said second signal on said second channel, and said transmitter has a means for outputting said first and second signals;

a first switch having a first terminal and a second terminal, said first terminal is electrically connected to a monostable multi-vibrator which is electrically connected to said first input of said transmitter and said second terminal is electrically connected to a source of electrical power, wherein said first switch is responsive to the opening and closing of said hinged mailbox door;

a second switch having a first terminal and a second terminal, said first terminal is electrically connected to said second input of said transmitter and said second terminal is electrically connected to a source of electrical power;

a two channel receiver, said receiver has an input responsive to said output of said transmitter, said receiver has a receiving means electrically connected to said input for receiving said first signal on said first channel and for receiving said second signal on said second channel, and said receiver has a first output and second output electrically connected to said receiving means;

a logic flip flop having a first input, a second input and an output, said first input is electrically connected to said first output of said receiver;

a logic OR gate having a first input, a second input and an output, said first input is electrically connected to said second output of said receiver, and said output is electrically connected to said second input of said logic flip flop;

a third switch having a first terminal and a second terminal, said first terminal is electrically connected to a source of electrical power, and said second terminal is electrically connected to said second input of said logic OR gate;

a visual indicator electrically connected to said logic OR gate; and an audible indicator electrically connected to said logic OR gate having a means for automatically extinguishing said audible indicator after a period of time.

* * * * *